US006908688B1

(12) United States Patent
Majagi et al.

(10) Patent No.: US 6,908,688 B1
(45) Date of Patent: Jun. 21, 2005

(54) GRADED COMPOSITE HARDMETALS

(75) Inventors: Shivanand Majagi, Rogers, AR (US); Robert W. Britzke, Rogers, AR (US); Daniel W. Nelson, Rogers, AR (US)

(73) Assignee: Kennametal Inc., Latrobe, PA (US)

( * ) Notice: Subject to any disclaimer, the term of this patent is extended or adjusted under 35 U.S.C. 154(b) by 674 days.

(21) Appl. No.: 09/632,400

(22) Filed: Aug. 4, 2000

(51) Int. Cl.[7] ..... B32B 3/10
(52) U.S. Cl. ..... 428/552; 428/565
(58) Field of Search ..... 428/552, 565; 419/18

(56) References Cited

U.S. PATENT DOCUMENTS

| | | | | |
|---|---|---|---|---|
| 2,888,247 | A | 5/1959 | Haglund | 255/63 |
| 3,451,791 | A | 6/1969 | Meadows | 29/182.8 |
| 3,850,368 | A | 11/1974 | Boeckeler | 233/25 |
| 3,888,662 | A | 6/1975 | Boeckeler | 75/203 |
| 3,909,895 | A | 10/1975 | Abrahamson et al. | 29/95 |
| 4,194,790 | A | 3/1980 | Kenny et al. | 299/79 |
| 4,249,955 | A | 2/1981 | Grab et al. | 106/308 |
| 4,303,416 | A | 12/1981 | Springborn | 51/293 |
| 4,359,335 | A | 11/1982 | Garner | 75/208 |
| 4,428,906 | A | 1/1984 | Rozmus | 419/48 |
| 4,484,644 | A | 11/1984 | Cook et al. | 175/410 |
| 4,491,559 | A | 1/1985 | Grab et al. | 419/36 |
| 4,547,337 | A | 10/1985 | Rozmus | 419/49 |
| 4,610,931 | A | 9/1986 | Nemeth et al. | 428/547 |
| 4,626,407 | A | * 12/1986 | Veltri et al. | 419/18 |

(Continued)

FOREIGN PATENT DOCUMENTS

| | | |
|---|---|---|
| CA | 1119850 | 3/1982 |
| DE | 3005684 | 8/1981 |
| DE | 3519101 | 5/1985 |
| DE | 8813731 | 5/1989 |
| DE | 196 34 314 A1 | 8/1996 |
| EP | 0072175 | 2/1983 |
| EP | 0111600 | 6/1984 |
| EP | 0194018 | 9/1986 |
| EP | 0233162 | 8/1987 |
| EP | 0498781 | 8/1992 |
| EP | 0542704 | 5/1993 |
| FR | 1522955 | 3/1968 |
| FR | 2343885 | 3/1977 |
| GB | 0659765 | 10/1951 |
| GB | 0806406 | 12/1958 |

(Continued)

OTHER PUBLICATIONS

"Cemented Carbide in High Pressure Equipment," B. Zetterlund, *High Pressure Engineering*, vol. 2 (1977), pp. 35–40.

(Continued)

*Primary Examiner*—Daniel Jenkins
(74) *Attorney, Agent, or Firm*—John J. Prizzi

(57) ABSTRACT

A multiple-region hardmetal tool piece. The tool piece includes a hardmetal body including a hard particle component and a binder; an additional body, the additional body including a hardmetal body having a hard particle component and a binder; a metal body or a ceramic body; a substantially discontinuous gradient-free boundary layer between the hardmetal body and the additional body; and a mating surface between the hardmetal body and the additional body. In the preferred embodiment, the hard particle components are a carbide, such as tungsten carbide. In the preferred embodiment, the mating surface includes a male portion on one of the bodies and a corresponding female portion on the other of the bodies. The mating surface is symmetrical or asymmetrical and, in the preferred embodiment, the mating surface is axially symmetrical, such as a dimple. The mating surface may further including both micro and macro mating features.

47 Claims, 4 Drawing Sheets

U.S. PATENT DOCUMENTS

| | | | | | |
|---|---|---|---|---|---|
| 4,705,124 | A | | 11/1987 | Abrahamson et al. | 175/410 |
| 4,722,405 | A | | 2/1988 | Langford, Jr. | 175/374 |
| 4,743,515 | A | | 5/1988 | Fischer et al. | 428/698 |
| 4,744,943 | A | | 5/1988 | Timm | 419/10 |
| 4,780,274 | A | * | 10/1988 | Barr | 419/7 |
| 4,797,326 | A | | 1/1989 | Csilag | 428/552 |
| 4,820,482 | A | | 4/1989 | Fischer et al. | 419/15 |
| 4,843,039 | A | * | 6/1989 | Akesson et al. | 501/87 |
| 4,854,405 | A | | 8/1989 | Stroud | 175/374 |
| 4,923,512 | A | | 5/1990 | Timm et al. | 75/239 |
| 4,945,073 | A | | 7/1990 | Dubensky et al. | 501/93 |
| 4,956,012 | A | | 9/1990 | Jacobs et al. | 75/236 |
| 5,074,623 | A | | 12/1991 | Hedlund et al. | 299/79 |
| 5,089,182 | A | | 2/1992 | Findeisen et al. | 264/8 |
| 5,156,725 | A | | 10/1992 | Doktycz et al. | 204/192.16 |
| 5,215,945 | A | | 6/1993 | Dubensky et al. | 501/94 |
| 5,232,522 | A | | 8/1993 | Doktycz et al. | 148/218 |
| 5,250,367 | A | | 10/1993 | Santhanam et al. | 428/698 |
| 5,256,608 | A | | 10/1993 | Dubensky et al. | 501/94 |
| 5,304,342 | A | * | 4/1994 | Hall, Jr. et al. | 419/11 |
| 5,333,520 | A | | 8/1994 | Fischer et al. | 76/108.2 |
| 5,335,738 | A | | 8/1994 | Waldenstrom et al. | 175/420.2 |
| 5,374,392 | A | | 12/1994 | Skelcey et al. | 419/49 |
| 5,453,241 | A | | 9/1995 | Akerman et al. | 419/14 |
| 5,467,669 | A | | 11/1995 | Stroud | 76/108.2 |
| 5,484,191 | A | | 1/1996 | Sollami | 299/105 |
| 5,541,006 | A | | 7/1996 | Conley | 428/552 |
| 5,543,235 | A | | 8/1996 | Mirchandani et al. | 428/547 |
| 5,593,474 | A | | 1/1997 | Keshavan et al. | 75/240 |
| 5,677,042 | A | | 10/1997 | Massa et al. | 428/212 |
| 5,679,445 | A | | 10/1997 | Massa et al. | 428/212 |
| 5,686,119 | A | | 11/1997 | McNaughton, Jr. | 425/130 |
| 5,697,042 | A | | 12/1997 | Massa et al. | 419/10 |
| 5,697,046 | A | | 12/1997 | Conley | 428/547 |
| 5,762,843 | A | | 6/1998 | Massa et al. | 264/60 |
| 5,776,593 | A | | 7/1998 | Massa et al. | 428/212 |
| 5,789,686 | A | | 8/1998 | Massa et al. | 75/240 |
| 5,792,403 | A | | 8/1998 | Massa et al. | 264/122 |
| 5,806,934 | A | | 9/1998 | Massa et al. | 299/111 |
| 5,809,848 | A | | 9/1998 | Viswanadham et al. | 76/112 |
| 5,889,219 | A | * | 3/1999 | Moriguchi et al. | 75/236 |
| 5,989,731 | A | * | 11/1999 | Arisawa et al. | 428/627 |

FOREIGN PATENT DOCUMENTS

| | | |
|---|---|---|
| GB | 0911461 | 11/1962 |
| GB | 1115908 | 6/1968 |
| GB | 1383429 | 2/1974 |
| GB | 2004315 | 3/1979 |
| GB | 2017153 | 10/1979 |
| GB | 2037223 | 7/1980 |
| GB | 2211875 | 7/1989 |
| WO | WO 99/03624 | 6/1998 |

OTHER PUBLICATIONS

"Utilization of Magnetic Saturation Measurements for Carbon ontrol in Cemented Carbides,", D.R. Moyle & E.R. Kimmel, *1984 ASM/SCTE Conference on Technology Advancements in Cemented Carbide Production*, Pitsburgh, PA 2–4 December 1984, also available as *Metals/Materials Technology Series No. 8415–009* (1984), pp. 1–5, American Society for Metals, Metals Park, Ohio.

"Binder Mean–Free–Path Determination in Cemented Carbide by Coercive Force and Material Composition," R. Porat & J. Malek, *Materials Science and Engineering, vol. A105/106* (1988), pp. 289–292.

"Standard Practice for Evaluating Apparent Grain Size and Distribution of Cemented Tungsten Carbides," ASTM Designation B 390–92, *1992 Annual Book of ASTM Standards*, vol. 02.05, pp. 1–4.

"Isotropic and Gradient Hard Metals Fabricated by Infiltration," M. Gasik, V. Jäervelä, K. Lilius & S. Stromberg, *Proceedings of the 13th International Plansee Seminar*, Eds. H. Bildstein & R. Eck, *Metallwerk Plansee*, vol. 2 (1993), pp. 553–561.

"Processing of Functional–Gradient WC–Co Cermets by Powder Metallurgy," C. Colin, L. Durant, N. Favrot, J. Besson, G. Barbier, & F. Delannay, *International Journal of Refractory Metals & Hard Materials*, vol. 12, No. 3 (1993–1994), pp. 145–152.

Viswanadham, R.K., "Stability of Microstructural Discontinuities in Cemented Carbides," *International Journal of Powder Metallurgy*, Oct. 1987, USA, vol. 23, No. 4, ISSN 0361–3488, pp. 229–235.

Richter, V., "Fabrication and Properties of Gradient Hard Metals, " *3rd International Symposium on Structural and Functional Gradient Materials, Proceedings of FGM '94*, Lausanne, Switzerland, Oct. 10–12, 1994, 1995, Lausanne, Switzerland, Presses Polytech. Univ., Romandes, Switzerland, whole document.

Almond et al., "Identification of Optimum Binder Phase Compositions for Improved WC Hard Metals, " *Materials Science & Engineering*, vol. A105/106, Nov. 1988, pp. 237–248, XP 000569230.

Roebuck, B., "Magnetic Moment (Saturation) Measurements on Hardmetals," NPL National Physical Laboratory, Teddington, Middlesex TW11 OLW, United Kingdom, Dec. 1994.

International Search Report for International Appn. No. PCT/US01/20204.

* cited by examiner

GRADED COMPOSITE HARDMETALS

BACKGROUND

The present invention relates generally to hardmetals and, more particularly, to a body having multiple-regions including at least one hardmetal body.

Hardmetal is a term used to describe a monolithic material composed of a hard particulate bond with a binder. The hard particulate comprises a nonmetallic compound or a metalloid. The hard particulate may or may not be interconnected in two or three dimensions. The binder comprises a metal or alloy and is generally interconnected in three dimensions. Each monolithic hardmetal's properties are derived from the interplay of the size distribution of the hard particulate, amount of the hard particulate, composition of the hard particulate and the composition of the binder.

A hardmetal family may be defined as a monolithic hardmetal consisting of a specified hard particulate combined with a specified binder component. Tungsten carbide bonded or cemented together by a cobalt alloy is an example of a WC-Co family and is commonly referred to as a WC-Co cemented carbide. The properties of a hardmetal family may be tailored, for example, by adjusting either separately or together an amount of the hard particulate, a size distribution of the hard particulate, or a composition of the binder. However, there is the principle that the improvement of one material property invariably decreases another. For example, in the WC-Co family as resistance to wear is improved through an increase in hard particulate amount that in turn results in the decrease of binder amount and the resistance to breakage generally decreases. A design around the principle is to combine several monolithic hardmetals to form a multiple-region hardmetal body.

The resources (i.e., both time and money) of many individuals and companies throughout the world have been directed to the development of multiple-region cemented carbide bodies. The amount of resources directed to the development effort is demonstrated by the number of publications, US and foreign patents, and foreign patent publications on the subject. Some of the many US and foreign patents, and foreign patent publications include: U.S. Pat. Nos. 2,888,247; 3,909,895; 4,194,790; 4,359,355; 4,427,098; 4,722,405; 4,743,515; 4,820,482; 4,854,405; 5,074,623; 5,333,520; and 5,335,738, and foreign patent publication nos. DE-A-3 519 101; GB-A 806 406; EPA-0 111 600; DE-A-3 005 684; DE-A-3 519 738; FR-A-2 343 885; GB-A-1 115 908; GB-A-2 017 153; and EP-A-0 542 704.

Some resources have been expended for "thought experiments" and merely present wishes—in that they fail to teach the methods of making such multiple-region cemented carbide bodies.

Other resources have been spent developing complicated methods. Some methods included the pre-engineering of starting ingredients, green body geometry or both. For example, the starting ingredients used to make a multiple-region cemented carbide body are independently formed as distinct green bodies. Sometimes, the independently formed green bodies are also independently sintered and, sometimes after grinding, assembled, for example, by soldering, brazing or shrink fitting to form a multiple-region cemented carbide body. Other times, independently formed green bodies are assembled and then sintered. The different combinations of the same ingredients that comprise the independently formed green bodies respond to sintering differently. Each combination of ingredients shrinks uniquely. Each combination of ingredients responds uniquely to a sintering temperature, time, atmosphere or any combination of the proceeding. Only the pre-engineering of forming dies and, thus, green body dimensions allows assembly followed by sintering. To allow the pre-engineering, an extensive database containing the ingredient's response to different temperatures, times, atmospheres or any combination of the proceeding is required. The building and maintaining of such databases are cost prohibitive. To avoid those costs, elaborate process control equipment might be used. This too is expensive. Further, when using elaborate process control equipment, minor deviations from prescribed processing parameters rather than yielding useful multiple-region cemented carbide bodies—yield scrap.

Still other resources have been expended on laborious methods for forming multiple-region cemented carbide bodies. For example, sub-stoichiometric monolithic cemented carbide bodies are initially sintered. Their compositions are deficient with respect to carbon and thus the cemented carbides contain eta-phase. The monolithic cemented carbide bodies are then subjected to a carburizing environment that reacts to eliminate the eta-phase from a periphery of each article. These methods, in addition to the pre-engineering of the ingredients, require intermediate processing steps and carburizing equipment. Furthermore, the resultant multiple-region cemented carbide bodies offer only minimal benefits since once the carburized peripheral region wears away, their usefulness ceases.

Some resent methods include those discussed in U.S. Pat. Nos. 5,541,006; 5,697,046; 5,686,119; 5,762,843; 5,789,686; 5,792,403; 5,677,042; 5,679,445; 5,697,042; 5,776,593; and 5,806,934, all assigned to Kennametal. Although these patents teach satisfactory alternatives for making multiple-region cemented carbide bodies there is still room for improvement.

It is apparent that there is a need for multiple-region cermet bodies and cemented carbide bodies that can be inexpensively manufactured. Further, there exists a need for multiple-region cermet bodies and cemented carbide bodies that further exhibit superior wear resistance and can be inexpensively manufactured.

SUMMARY OF THE INVENTION

The present invention is directed to a new and improved multiple-region tool piece including a hardmetal. The tool piece includes a hardmetal body including a hard particle component and a binder; an additional body, which may include a metal body, a ceramic body, and/or an additional hardmetal body including a hard particle component and a binder; a substantially discontinuous gradient-free boundary layer between the hardmetal body and the additional body; and a mating surface between the hardmetal body and the additional body.

In the preferred embodiment, the hard particle components are a carbide, such as a tungsten carbide. The carbide grain size may be about 0.2 micrometers ($\mu$m) to about 40 $\mu$m. The hardmetal body binder is selected from one of cobalt, nickel and iron and their alloys, with cobalt being preferred. Also, in the preferred embodiment, the binder is about 0 weight percent (wt. %) to about 25 wt. % of the hardmetal body.

In the preferred embodiment, the mating surface includes a male portion on one of the bodies (e.g., a metal body, a ceramic body, and/or a hardmetal body) and a corresponding female portion on the other of the bodies (e.g., a metal body, a ceramic body, and/or a hardmetal body). The mating surface may be symmetrical, such as axially symmetrical (e.g., a dimple) or asymmetrical. In a preferred embodiment when the size of the bodies are substantially disparate, the mating surface is asymmetrical, such as when a body of a thickness of about 20 $\mu$m to about 30 is incorporated on or into the surface of another body. The mating surface may further including both micro and/or macro mating features.

These and other features, aspects and advantages of the present invention will be better understood with reference to the following description of the preferred embodiment, appended claims and accompanying drawings.

DESCRIPTION

Figure 1A:
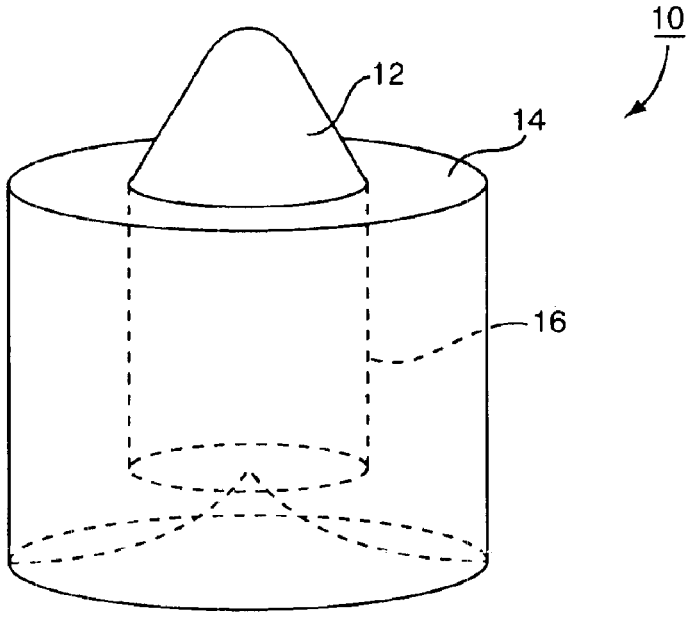
FIG. 1A depicts an isometric view of a bit constructed according to an aspect of an embodiment of the present invention.

In the following description, like reference characters designate like or corresponding parts throughout the several views. Also in the following description, it is to be understood that such terms as "forward," "rearward," "left," "right," "upwardly," "downwardly," and the like are words of convenience and are not to be construed as limiting terms.

Figure 1B:
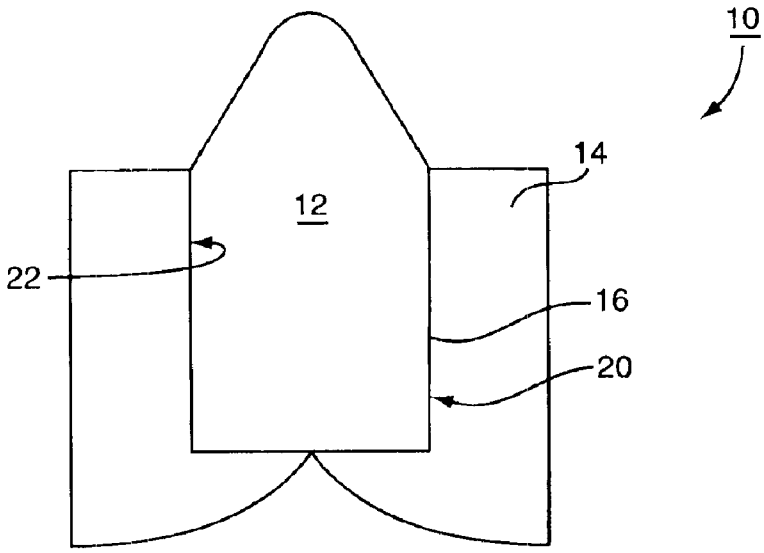
FIG. 1B depicts a cross-sectional schematic view of the bit of FIG. 1A according to an aspect of an embodiment of the present invention.

Referring now to the drawings in general and FIGS. 1A–1B in particular, it will be understood that the illustrations are for the purpose of describing a preferred embodiment of the invention and are not intended to limit the invention thereto. As best seen in FIG. 1, a multiple-region body or bit, generally designated 10, is shown constructed according to the present invention. Bit 10 is comprised of a hardmetal body 12 and an additional body 14 with a mating surface FIG. 2B shows a cross-sectional schematic view of the hardmetal body 12 and the additional body 14 of the bit 10 emphasizing the male mating surface 20 and the female mating surface 22.

Figure 2A:
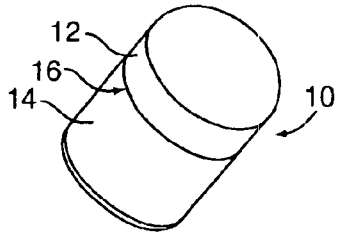
FIG. 2A depicts a bit constructed according to an aspect of an embodiment of the present invention.
Figure 2B:
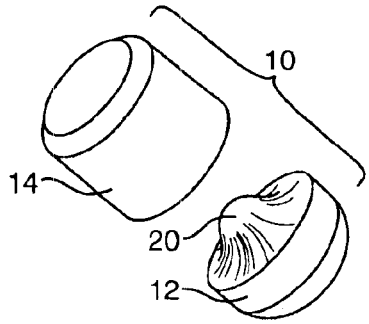
FIG. 2B depicts an exploded view of the bit of FIG. 2A demonstrating the male mating surface according to an aspect of an embodiment of the present invention.
Figure 2C:
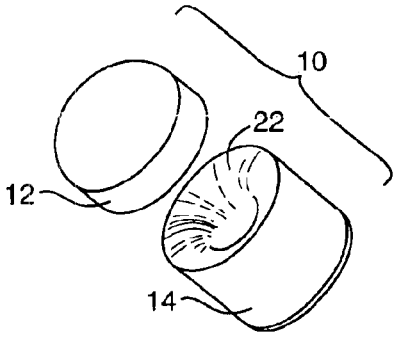
FIG. 2C depicts an exploded view of the bit of FIG. 2A demonstrating the female mating surface according to an aspect of an embodiment of the present invention.

Referring now to FIGS. 2A–2C, a multiple-region body or bit, generally designated 10, is shown constructed according to the present invention. Bit 10 is comprised of a hardmetal body 12 and an additional hardmetal body 14 with a mating surface 16 (only the exterior interfacial line is shown in FIG. 2A). FIG. 2B shows an exploded view of the hardmetal body 12 and the additional hardmetal body 14 of the bit 10 emphasizing the male mating surface 20. FIG. 2C shows an exploded view of the hardmetal body 12 and the additional hardmetal body 14 of the bit 10 emphasizing the female mating surface 22.

The present invention is related to the multiple-region body having a hardmetal body 12; an additional body 14, which may be a metal body, a ceramic body and/or an additional hardmetal body; and a mating surface 16 there between. Each hardmetal body comprises a hard particulate component bound by a binder. As discussed in greater detail below, the hard particulate may comprise any of those known in the art and preferably comprises a carbide, even more preferably a tungsten carbide. When a carbide is used, the grain size of the hard particulate may be about 0.2 to 40 $\mu$m. Also as discussed in greater detail below, the binder for each of the hardmetal bodies may comprise any of those known in the art including cobalt, nickel, iron, combinations thereof and alloys thereof. The binder content for each hardmetal body may be about 0 wt. % to about 25 wt. %.

In another aspect of the present invention, the second body is any one of a metal body, a ceramic body, and an additional hardmetal body. Any metal body or ceramic body that will survive the processing used to make multiple-region bodies that have the desired function may be used. Examples of metal bodies include iron and iron based alloys (e.g., steels); nickel and nickel based alloys; cobalt and cobalt based alloys; and combinations thereof. Examples of ceramic bodies include at least one of boride(s), nitride(s), carbide(s), oxide(s), silicide(s), their mixtures, their solutions, and any combination of the preceding such as borocarbides, boronitrides, carbonitrides, oxynitrides, oxycarbonitrides and borocarbonitrides. Composites of two or more of the preceding are also contemplated. The metal of the at least one of borides, nitrides, carbides, oxides, or suicides includes one or more metals from IUPAC groups 2, 3 (including lanthanides and actinides), 4, 5, 6, 7, 8, 9, 10, 11, 12, 13 and 14. Preferably, additional hard components comprise one of boride(s), nitride(s), carbide(s), oxide(s), or silicide(s) their mixtures, their solutions and any combination of the preceding. The metal of the of boride(s), nitride (s), carbide(s), oxide(s), or silicide(s) comprises one or more metals from IUPAC groups 3 (including lanthanides and actinides), 4, 5, and 6; and more preferably one or more of Ti, Zr, Hf, V, Nb, Ta, Cr, Mo and W. Examples of ceramics included, without limitation, alumina, zirconia, silicon nitride, aluminum nitride, silicon carbide, boron carbide, titanium boride, titanium nitride, silicon oxynitride, as well as composites thereof.

Various aspects of the present invention relating to a hardmetal body and an additional hardmetal body may include the following: (1) the binder content of the hardmetal body being different from the additional hardmetal body; (2) the grain size of the hard particulate of the hardmetal body being different from that of the additional hardmetal body; (3) binder composition of the hardmetal body being different from the additional hardmetal body; (4) the hard particulate composition of the hardmetal body being different from that of the additional hardmetal body; and any combination thereof such as (5) both the binder content and the grain size of the hard particulate of the hardmetal body being different from that of the additional hardmetal body; (6) both the binder content and composition of the hardmetal body being different from that of the additional hardmetal body; (7) both the binder composition and the grain size of the hardmetal body being different from the additional hardmetal body; (8) both the grain size and hard particulate composition of the hardmetal body being different from the additional hardmetal body; (9) the binder content, grain size of the hard particulate and binder composition of the hardmetal body being different from that of the additional hardmetal body . . . etc.

Figure 3A:
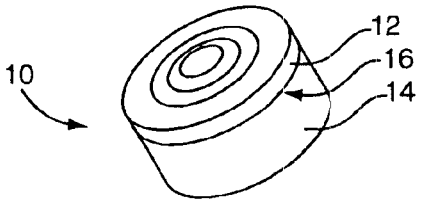
FIG. 3A depicts a superhard material substrate carrier according to an aspect of an embodiment of the present invention.
Figure 3B:
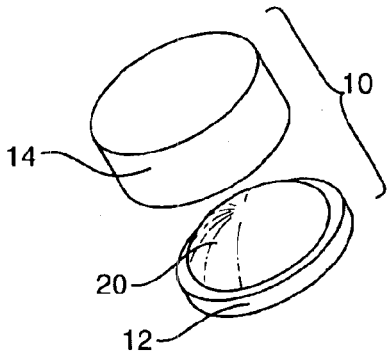
FIG. 3B depicts an exploded view of FIG. 3A demonstrating the male mating surface according to an aspect of an embodiment of the present invention.
Figure 3C:
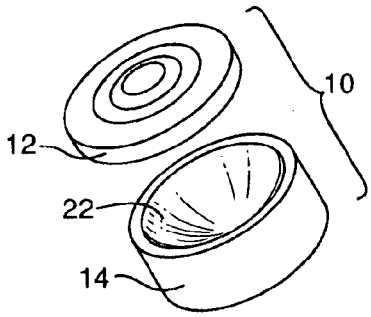
FIG. 3C depicts an exploded view of FIG. 3A demonstrating the female mating surface according to an aspect of an embodiment of the present invention.

Another aspect of the present invention relates to the use of a multiple-region body as a superhard material support as illustrated in FIG. 3A. Superhard materials may include diamond, cubic boron nitride, and carbon nitride. Specifically, the body or superhard material support 10 is comprised of a hardmetal body 12 and an additional hardmetal body 14 with a mating surface 16 therebetween. FIG. 3B shows an exploded view of the hardmetal body 12 and the additional hardmetal body 14 of the superhard material support 10 emphasizing the male mating surface 20. FIG. 3C shows an exploded view of the hardmetal body 12 and the additional hardmetal body 14 of the superhard material support 10 emphasizing the female mating surface 22.

With regard to the multiple-region body 10 of FIGS. 1A–3C, it will be understood that the types of bodies illustrated therein are for the purpose of demonstrating certain aspects of the present invention and are not intended to limit the types nor geometry of bodies that applicants contemplate may be made according to the present invention. Other types of bodies incorporating multiple-region bodies contemplated to be within the scope of the present invention include, among others, bodies for materials manipulation and removal applications, such as, buttons or inserts, or portions of buttons or inserts, for oil field tools, petroleum industry or exploration tools, mining, construction, agricultural, wear, and metal removal applications, some of which are discussed in more detail herein and others which will be apparent to those skilled in the art.

Figure 4:
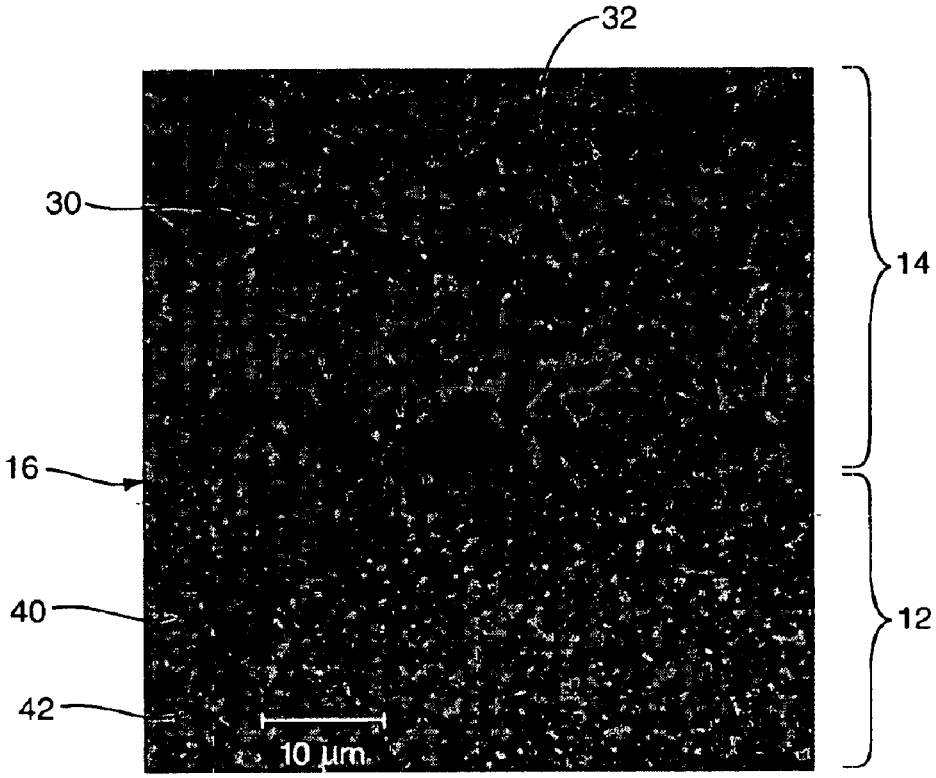
FIG. 4 depicts a microstructure of a mating surface between a hardmetal body and an additional hardmetal body according to an aspect of an embodiment of the present invention.

In a polished metalographic cross section, the distinct bodies making up a multiple-region body according to the present invention can be seen. For example, as demonstrated by the rendering of a photomicrograph of FIG. 4 from a hardmetal body 12 and an additional hardmetal body 14, the hardmetal body 12 is comprised of hard particles 40 bound together by binder 42. The mating surface 16 between the hardmetal body 12 and the additional hardmetal body 14 is distinct. Further, the additional hardmetal body 14 is comprised of hard particles 40 bound together by binder 32. Another feature that becomes apparent after further metallographic analysis of the multiple-region bodies is the substantially pore-free nature of the hardmetal body or bodies and/or the substantially gradient-free boundary therebetween. For example, when the porosity of the bodies is determined using ASTM Standard B 276-91, Standard Test Method for Apparent Porosity in Cemented Carbides, values up to A00, B00 and C00 are obtained. Porosities better than A02, B00 and C00 may be a characteristic of the hardmetal body and the additional hardmetal body; however, the porosity may not be any higher than A06, B00 and C08. When observing the interface or boundary between a hardmetal body and an additional body that is a metal body or a ceramic body, again substantially no porosity is observed at the interface.

Yet another aspect of the present invention relates to the nature of the mating surfaces between the hardmetal body and the additional body. For example, the multiple-region bodies 10 in FIGS. 2 and 3 depict the mating surface 16 of the hardmetal body 12 as a male mating surface 20 while that of the additional hardmetal body 14 as a female mating surface 22. The mating surface 16 may be described as reference macro feature including perturbations that may be described as micro features. The perturbations increase, for example, the interfacial surface area of the perturbed macro feature relative to an unperturbed macro feature. For example, a planar surface may be the reference macro feature that may be perturbed to include micro features such as a substantially square wave feature, a substantially triangular wave feature, a substantially sinusoidal wave feature and combinations thereof. A convenient approach for describing the micro and macro features may be the ratio of the area of an unperturbed macro feature to the area of the same but perturbed macro feature. For example, an unperturbed reference macro feature for a bit 10 as shown in FIG. 2 may be a disk having an area of $\pi r^2$, where r is the radius of the right cylinder. The perturbed macro feature may be approximated as a hemisphere having an area of $2\pi r^2$. The ratio of the macro feature area to the perturbed macro feature area for this example is $\pi r^2:2\pi r^2$ or 1:2. Applicants believe that the macro feature area:perturbed macro feature area ratio may range from approximately just greater than about 1:1 to about 1:50, preferably from approximately just greater than about 1:1 to about 1:25, and more preferably from approximately just greater than about 1:1 to about 1:10. The perturbation of a macro feature provides a mechanical interlock between the hardmetal body and the additional body that increases interfacial bond strength of the two bodies to provide a longer lasting multiple-region body in use.

In an aspect of the present invention, the mating surfaces may be described as being symmetrical, for example, about an axis or plane or even exhibiting rotational symmetry or mirror symmetry. Similarly, the mating surfaces may be described as being asymmetrical. Applicants have found that when the bodies of a multiple-region body have substantial size disparities, it is advantageous for the mating surface to be asymmetrical. For example, when an additional body having a thickness of about 20–30 $\mu$m is incorporated on a hardmetal body in the centimeter scale, asymmetrical mating surfaces provide superior integrating in the resultant multiple-region body. Applicants believe that arrangement of a hardmetal body and an additional hardmetal body would be particularly advantageous when the additional hardmetal body comprises a superhard filler hardmetal body such as that disclosed in commonly assigned U.S. Pat. No. 6,372,012 that issued on Apr. 16, 2002 from U.S. Application Serial No. 09/616,112, entitled A SUPERHARD FILLER HARDMETAL INCLUDING A METHOD OF MAKING, filed on Jul. 13, 2000, in the names of S. Majagi, J. Eason, and R. W. Britzke, the disclosure of which is hereby incorporated by reference herein.

Figure 5:
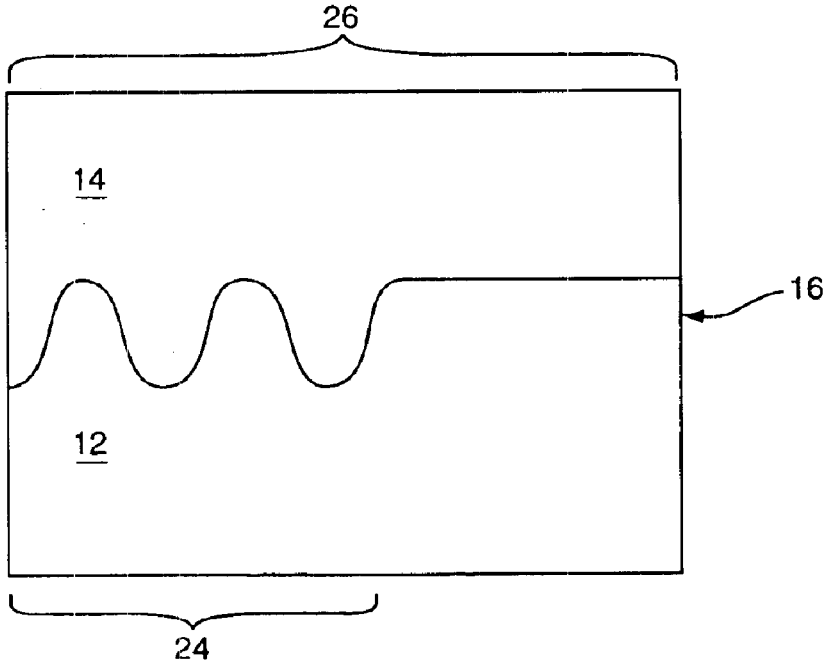
FIG. 5 depicts a mating surface containing micro and macro components according to an aspect of an embodiment of the present invention.
Figure 6A:
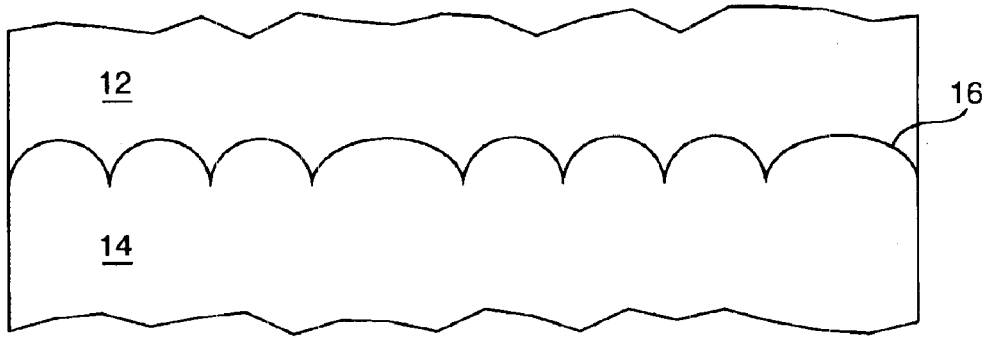
FIGS. 6A–6C depict cross-sectional schematic views of mating surfaces according to an aspect of an embodiment of the present invention.
Figure 6B:
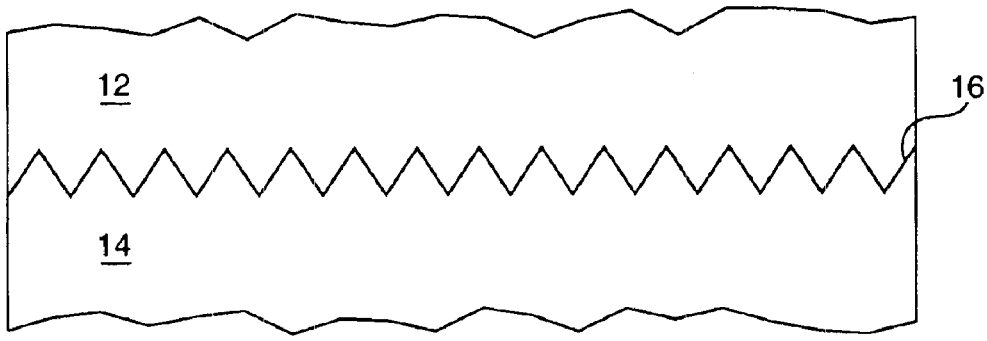
Figure 6C:
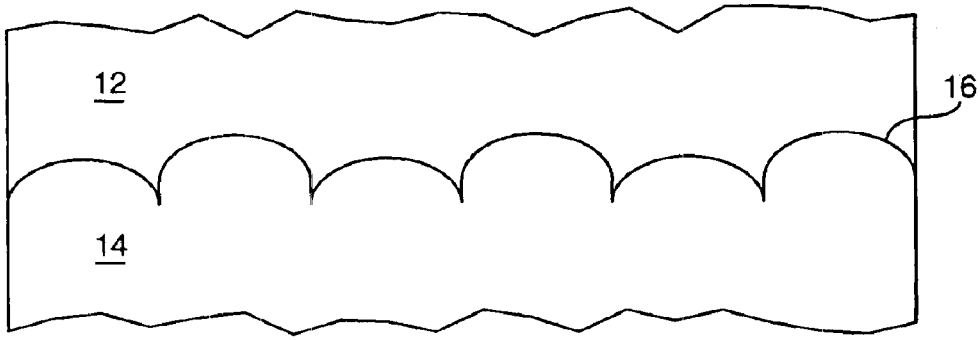

Another feature of the present invention is illustrated in FIG. 5. Specifically, FIG. 5 shows a macro interface 26 that is substantially flat in cross sectioned, with a micro feature 24 characterized as a sinusoidal interlocking of the hardmetal and additional hardmetal. FIGS. 6A–6C present cross sectional schematics of macro and/or micro interfacial features. Applicants contemplate that the macro and/or micro interfacial features may comprise any variety of features including those having uniformity, shape variations, height variations, width variations, height and width variations, shape and height variations, shape and width variations, and shape, height and width variations. FIG. 6A depicts a feature having, among other things, a width variation where half circles are regularly alternated with half ovals or half ellipses to create mating surface 16. FIG. 6B depicts a feature having, among other things, a shape variation where triangles are uniformly distributed to create mating surface 16. FIG. 6C depicts a feature having, among other things, a height variation where half ovals or half ellipses of different heights are distributed to create mating surface 16. Applicants contemplate that other shapes may be used to create a mating surface such as a sawtooth curve, a sinusoidal curve, portions and/or truncations of such curves either alone or in combination with whole and/or truncated half circles, half ovals, half ellipses and triangles.

Some macro and/or micro interfacial features of mating surface 16 may be represented as a periodic function that may be subdivided into a finite number of continuous intervals within its period. Such a function may be expanded in its interval into a convergent series known in mathematics as a Fourier series. See for example, Gieck, K. "Arithmetic: Fourier Series" in: Engineering Formulas (New York, N.Y., McGraw-Hill Book Company 1979, pp. D12–D14), which is herein incorporated by reference. Macro and/or micro interfacial features that may be represented using Fourier series include symmetrical features and asymmetrical features. Some examples include half circles, half ovals, half ellipses, triangles, sawtooth curves, and truncated versions of any of the preceding. In addition, an interfacial feature having frequency modulation, amplitude modulation, and frequency and amplitude modulation may be represented by a Fourier series. To that end, applicants contemplate that any macro and/or micro interfacial feature having mating surface strength enhancing ability may be represented as a Fourier series and may be used as a mating surface 16.

Cemented Carbides

In an aspect of the present invention, the multiple-region body 10 comprises cemented carbide bodies. In this aspect, each hardmetal body, which may include a hardmetal body and, optionally, an additional hardmetal body, includes a hard particulate comprising a carbide of one or more metals from IUPAC groups 3 (including lanthanides and actinides), 4, 5, 6, their mixtures, their solutions, and any combination of the preceding. Preferably, the hard particulate comprises a carbide of one or more of Ti, Zr, Hf, V, Nb, Ta, Cr, Mo, W, their mixtures, their solutions, and any combination of the preceding. More preferably, the hard particulate comprises a carbide of tungsten, its mixtures, its solutions, any combination of the preceding.

The size of a hard particulate according to this aspect may range from submicrometer to about 500 $\mu$m or greater. Submicrometer includes nanostructured hard particulate having structural features ranging from about 1 nanometer to about 100 nanometers or more.

In an aspect relating to cemented carbides, in particular tungsten carbide cemented carbide, the size of a hard particulate may range from submicron to about 500 $\mu$m or greater. Preferred sizes of a hard particulate comprising WC range from about 0.2 $\mu$m to about 40 $\mu$m.

Cermets

In an alternative aspect of the present invention, the multiple-region body 10 comprises cermet bodies. In this alternative aspect, each hardmetal body, which may include a hardmetal body, and, optionally, an additional hardemtal body, includes a hard particulate comprising a carbonitride of one or more metals from IUPAC groups 3 (including lanthanides and actinides), 4, 5, 6, their mixtures, their solutions, and any combination of the preceding. Preferably, the hard particulate comprises a carbonitride of one or more of Ti, Zr, Hf, V, Nb, Ta, Cr, Mo, W, their mixtures, their solutions, and any combination of the preceding. More preferably, the hard particulate comprises a carbonitride of titanium, its mixtures, its solutions, any combination of the preceding.

The size of a hard particulate according to this alternative aspect may range from submicrometer to about 500 $\mu$m or greater. Submicrometer includes nanostructured first hard component 14 having structural features ranging from about 1 nanometer to about 100 nanometers or more.

Binder

In any of the preceding aspects of embodiments and/or embodiments, the binder may comprise one or more metals from IUPAC groups 8, 9 and 10; more preferably, one or more of iron, nickel, cobalt, their mixtures, and their alloys. When the multiple-region body 10 comprises a cermet, the binder preferably comprises nickel or nickel alloys such as nickel-iron alloys and nickel-cobalt alloys. When the multiple-region body 10 comprises a cemented carbide, the binder preferably comprises cobalt or cobalt alloys such as cobalt-tungsten alloys and cobalt-nickel-iron alloys. The binder may comprise a single elemental metal, mixtures of metals, alloys of metals and any combination of the preceding.

An amount of binder of a hardmetal body according to any of the above embodiments may comprise about 0 wt. % to about 25 wt. % or greater.

Additional Hard Particulate

In any of the preceding aspects of the embodiments and the embodiments, a second hard particulate, a third hard particulate, and any additional hard particulate of a hardmetal body may comprise at least one of boride(s), nitride(s), carbide(s), oxide(s), silicide(s), their mixtures, their solutions, and any combination of the proceeding. The metal of the at least one of borides, carbide, oxides, or suicides includes one or more metals from IUPAC groups 2, 3 (including lanthanides and actinides), 4, 5, 6, 7, 8, 9, 10, 11, 12, 13 and 14. Preferably, additional hard components comprise one of boride(s), nitride(s), carbide(s), oxide(s), or silicide(s) their mixtures, their solutions and any combination of the preceding. The metal of the of boride(s), nitride(s), carbide(s), oxide(s), or silicide(s) comprises one or more metals from IUPAC groups 3 (including lanthanides and actinides), 4, 5, and 6; and more preferably one or more of Ti, Zr, Hf, V, Nb, Ta, Cr, Mo and W. Silicon carbide is an additional hard particulate that applicants believe may be advantageously used. Other additional hard particulates or further hard particulates may include intermetallics such as aluminides of nickel (e.g., $Ni_3Al$, NiAl, . . . , etc.), aluminides of titanium (e.g., TiAl, . . . , etc.), and alumina.

Making A Multiple-Region Body

A multiple-region body 10 may be produced by starting with conventional powder metallurgical technology as described in, for example, "World Directory and Handbook of HARDMETALS AND HARD MATERIALS" Sixth Edition, by Kenneth J. A. Brookes, International Carbide DATA (1996); "PRINCIPLES OF TUNGSTEN CARBIDE ENGINEERING" Second Edition, by George Schneider, Society of Carbide and Tool Engineers (1989); "Cermet-Handbook", Hertel AG, Werkzeuge +Hartstoffe, Fuerth, Bavaria, Germany (1993); "CEMENTED CARBIDES", by P. Schwarzkopf & R. Kieffer, The Macmillan Company (1960); and any of U.S. Pat. Nos. 5,541,006; 5,697,046;

5,686,119; 5,762,843; 5,789,686; 5,792,403; 5,677,042; 5,679,445; 5,697,042; 5,776,593; and 5,806,934, all assigned to Kennametal—the subject matter of which is herein incorporated by reference in its entirety in the present application.

In forming a multiple-region body 10, at least one mixture of a hard particulate, optionally an additional hard particulate and a binder or binder precursor is formed. Methods for forming such mixtures are described in, for example, U.S. Pat. Nos. 4,070,184; 4,724,121; 5,045,277 and 5,922,978, and include spray drying and mechanical mixing. The binder or binder precursor may be any source such as metal powders or composite powders previously described that may be intimately mechanically mixed with the hard particulate and, when used, an additional hard particulate. Preferably the binder or binder precursor is a metal powder that has an average particle size that is at most about 10 $\mu$m in diameter, more preferably at most about 5 $\mu$m, and most preferably at most about 2 $\mu$m in diameter. The binder or binder precursor powder is desirably of a purity that does not form undesirable phases or promote the formation of undesirable phases such as eta phases in the superhard filler hardmetal comprising tungsten carbide. Preferably the binder or binder precursor powder contains an amount of contaminants of at most about 1 percent by weight of the metal powder, contaminants being elements other than C, W, Fe, Co or Ni. More preferably the amount of contaminants is at most about 0.5 percent, and most preferably 0.2 percent by weight of the transition metal powder.

Each mixture may also contain organic additives such as binders that improve the ability of each mixture to be shaped into a porous body. Representative binders include paraffin wax, synthetic waxes such as microcrystalline wax, or linear or branched chain polymers such as polyethylene or polypropylene. The binders, typically, are soluble in a solvent such as a straight chain alkane (e.g., heptane) that may be used to mix the components of the mixture together.

Each mixture is formed by mechanically mixing the hard particulate, a binder or binder precursor and any optional components, such as an additional hard particulate or organic additives as previously described. The mechanical mixing may be any convenient form of mechanical mixing, such as ultrasonic agitating, ball milling, attriting, homogenizing v-blending or mixing and stirring, that intimately mixes the hard particulate, the additional hard particulate when used, and a binder or binder precursor. In an embodiment including a hard particulate and a binder or binder precursor, ball milling or attrition is preferably used.

Each mixture, including the hard particulate and the binder or binder precursor may be mixed dry or in a solvent as long as the environment does not deleteriously oxidize or hydrolyze the mixture's components. Preferably, a mixture is prepared in a solvent such as a low molecular weight straight chain alkane such as octane, heptane or hexane, which may be, subsequently, removed by drying, the drying being a convenient method such as vacuum or spray drying.

Each mixture is then formed, either serially or in parallel, into a green body by a convenient method such as those known in the art, examples being, uniaxial pressing in hard steel tooling, dry or wet bag cold isostatic pressing in rubber tooling, extrusion and injection molding. The particular method is selected primarily by the shape that is desired. For the present invention, uniaxial pressing, dry or wet bag isopressing produce satisfactory results. Some of these methods are described in, for example, U.S. Pat. Nos. 5,541,006; 5,697,046; 5,686,119; 5,762,843; 5,789,686; 5,792,403; 5,677,042; 5,679,445; 5,697,042; 15,776,593; and 5,806,934.

Before consolidating, the green body may be heated to remove any organic additives that may have been added to aid processing. This heating, commonly referred to as dewaxing, may be performed at a temperature ranging from 300° C. to about 700° C. under vacuum, inert gas or reducing gas. A particularly suitable dewax cycle is heating to about 350° C. under vacuum for a time sufficient to remove most of the organic additives followed by heating to 450° C. in an atmosphere containing hydrogen gas. Alternative gas atmospheres, such as argon, and even a vacuum may be used in the dewax cycle.

The green body is then consolidated at a temperature, superatmospheric pressure, time at temperature and time at superatmospheric pressure sufficient to form a densified multiple-region body. The consolidation may occur with or without the formation of a liquid in the body. The consolidation temperature should be sufficiently high to cause the green body to densify at the superatmospheric pressure described herein. In a preferred aspect, the temperature should also be less than a temperature where a liquid phase is formed in the green body with little, if any, grain growth of the hard component. A suitable temperature range is from about 800° C. to about 1500° C., preferably about 800° C. to about 1350° C., more preferably from about 900° C. to about 1300° C., even more preferably from about 1000° C. to about 1300° C., and most preferably from about 1050° C. to about 1250° C.

The consolidation time may be as short as possible while still forming the densified multiple-region body. The consolidation time should be a time that precludes excessive grain growth of substantially all the hard particulate while still achieving the desired density of the multiple-region body. Preferably, the time and temperature are such that the hard particulate exhibits substantially no growth, and stay substantially the same before and after consolidation at elevated temperatures. Suitable times range from about 1 minute to about 24 hours. Preferably, the time is at most about 12 hours, more preferably at most about 6 hours, even more preferably at most about 3 hours, and most preferably at most about 1 hour to preferably at least about 5 minutes, more preferably at least about 10 minutes, and most preferably at least about 15 minutes.

The entire time or only a portion of the time at the consolidation temperature may be at the elevated pressure according to the present invention (i.e., the time at superatmospheric pressure is less than or equal to the time at temperature). For practical reasons, the time at superatmospheric pressure is advantageously as short as possible while still attaining the densified multiple-region body 10. Preferably, the time at superatmospheric pressure at the consolidation temperature is at most about 30 minutes, more preferably at most about 10 minutes, even more preferably at most about 60 seconds and most preferably at most about 15 seconds to preferably at least about 2 seconds.

The superatmospheric pressure at the consolidation temperature should be at least a pressure such that the resulting graded composite or multiple-region body includes a hardmetal essentially free of porosity. For example, a porosity better than A02, B00 and C00, such as A00, B00 and C00, may be one characteristic of a hardmetal body; however, a porosity no greater than A06, B00 $_{and\ C}$08 is believed to be sufficient. The superatmospheric pressure should be less than a pressure, wherein the graded composite hardmetal would start to plastically deform to an extent where catastrophic failure of the body 10 may occur. Preferably, the superatmospheric pressure is at most about 1,000,000 pounds per square inch "psi" (6.89 GPa), more preferably at most about 500,000 psi (3.45 GPa) to at least about 10,000 (68.9 MPa) psi, more preferably at least about 50,000 psi (345 MPa), and most preferably at least about 100,000 psi (689 MPa).

Representative methods for consolidation the green body include Rapid Omnidirectional Compaction (ROC), placing a green body in a bed of pressure transmission particles, hot isostatic pressing (HIP), uniaxial hot pressing, or pressureless or vacuum sintering followed by one of the aforementioned superatmospheric techniques, an example being sinter-HIP. Various aspect of using a bed of pressure transmitting particles are taught by Meeks et al. (U.S. Pat. Nos. 5,032,352 and 4,975,414); Anderson et al. (U.S. Pat. Nos. 4,980,340 and 4,808,224); Oslin (U.S. Pat. No. 4,933,140); and Chan et al. (U.S. Pat. No. 4,915,605). Various aspects of sinter-HIP are taught by Lueth (U.S. Pat. Nos. 4,591,481 and 4,431,605). Preferably, the method consolidation comprises ROC-various aspects being taught by Timm (U.S. Pat. No. 4,744,943), Lizenby (U.S. Pat. Nos. 4,656,002 and 4,341,557), Rozmus (U.S. Pat. No. 4,428,906) and Kelto (Metals Handbook, "Rapid Omnidirectional Compaction" Vol. 7, pages 542–546), the subject matter of each is hereby incorporated in its entirety herein by reference.

In the ROC process according to the present invention, multiple green bodies, a green body and a sintered body, multiple sintered bodies, a green body and a ceramic metal body, or a sintered hardmetal and a ceramic or metal body are first embedded in a pressure transmitting material that acts like a viscous liquid at the consolidation temperature, the material and green body being contained in a shell. The green body may be enveloped in a barrier layer such as graphite foil or boron nitride. Suitable pressure transmitting materials include glasses that have sufficient viscosity so that the glass fails to penetrate the body under an applied pressure. Representative glasses include glasses containing high concentrations of silica and boron. A commercial glass useful in the temperature range from 1000° C. to 1400° C. is Corning-type PYREX 7740™ glass. Pressure transmitting materials are described in more detail in U.S. Pat. Nos. 4,446,100; 3,469,976; 3,455,682 and 4,744,943. Each patent relating to consolidation incorporated herein by reference in their entirety.

The shell containing the green body or green bodies and pressure transmitting medium preferably forms an enclosed right cylinder that can be placed in pot die tooling of a forging press. The pot die tooling, as it is known in the forging industry, consists of a cylindrical cavity closed at one end by an ejector assembly and at the other by a cylindrical ram. Upon compression in the tooling, the shell must distort predictably and not crack or leak.

The preferred shell material for the temperature range from 150° C. to about 1650° C. using glass pressure transmitting media is a shell cast of a thixotropic ceramic, as described by U.S. Pat. No. 4,428,906, at col. 3, lines 58–68, and col. 4, lines 1–27, incorporated herein by reference. The thixotropic ceramic material comprises a ceramic skeleton network and pressure transmitting material that deforms or fractures allowing compression of the pressure transmitting material, while retaining enough structural integrity to keep the pressure transmitting fluid from leaking out of the pot die.

Once the bodies are embedded in the pressure transmitting material contained in the shell, this shell assembly is heated in an inert atmosphere to a temperature suitable for forging. The temperature of this step is as described previously. The time at temperature must be a time sufficient to completely fluidize the pressure-transmitting medium and to bring the bodies to a temperature roughly in equilibrium with the temperature of the pressure transmitting material. Typical times range from about 1 to 3 hours for both heating to the consolidation temperature and maintaining the consolidation temperature. The time at the sintering temperature is maintained generally from about 1 to 30 minutes before being pressed in the pot die of the forging pressed described below.

The heated shell assembly is pressed in a forging press as described below and by Timm, U.S. Pat. No. 4,744,943, at col. 9, lines 50 68, and col. 10, lines 1 3, incorporated herein by reference. The heated shell is pressed in the forging press by compressing the assembly with a ram in a closed cavity such as the pot die tooling previously described. As the ram compresses the assembly in the cavity, the pressure transmitting material exerts a large hydrostatic pressure on the bodies to densify them. The shell material of the assembly flows into the clearance between the ram and pot die and forms, in effect, a pressure seal so that the liquid pressure transmitting material does not escape into the pot die. After pressing, the shell assembly is ejected from the pot die.

After ejection from the pot die, the densified bodies are separated from the pressure transmitting material (PTM) by a method such as pouring the liquid PTM through a screen, the densified bodies being retained on the screen which is described in greater detail in Timm, U.S. Pat. No. 4,744,943, at col. 10, lines 5–27, incorporated herein by reference. Any residual material remaining on the bodies may be removed by, for example, sand blasting. The entire assembly may also be cooled to room temperature before removing the densified bodies. The bodies are subsequently removed from the hardened glass PTM, for example, by breaking the glass PTM with a hammer. Further finishing of the densified bodies such as grinding and polishing may be performed.

The present invention is illustrated by the following, which is provided to demonstrate and clarify various aspects of the present invention. The following should not be construed as limiting the scope of the claimed invention.

Raw materials used preparing a hardmetal for a multiple-region body are listed in Table 1. Source for these materials are known by those skilled in the art and include Kennametal Inc. Latrobe, Pa., USA, Teladyne Advanced materials located in Levern Tenn., OMG headquartered in Cleveland, Ohio, Osram materials corporation located in Towanda, Pa., USA.

Spray-dried mixtures comprising tungsten carbide with about 0 wt. % to about 20 wt. % cobalt pressed into green bodies were mated to a second body and subsequently subjected to dewaxing. The green bodies were consolidated using ROC at about 1150° C. for a couple of minutes to produce multiple-region bodies. Several of the multiple-region bodies were cut, mounted, and polished to study their microstructures. The results of an examination of the interface between the hardmetal and the additional hardmetal revealed good bonding between them. The multiple-region bodies contained substantially no porosity.

TABLE 1

| Starting Materials | | |
|---|---|---|
| Material | Size | Source |
| Tungsten Carbide | 0.2–40 μm | OMG, Osram, Kennametal |
| Cobalt | 0.2–5 μm | OMG, Afro-Met |

TABLE 2

| Comparison of the Prior Art | | | |
|---|---|---|---|
| Prior Art 1 | | | |
| | 1st Green Body | 1st Hardmetal Body | Comments |
| Wt. % Binder | 10.9 | 5.95 | Binder migrated into this body from the second |
| Binder Chemistry | Cobalt | Cobalt | |
| Particle Size | 6.7 μm | 7.8 μm | |
| | 2nd Green Body | 2nd Hardmetal Body | Comments |
| Wt. % Binder | 9.6 | 11.4 | Binder migrated from this body into the first |
| Binder Chemistry | Cobalt | Cobalt | |
| Particle Size | 2.8 μm | 2.8 μm | |
| Prior Art 2 | | | |
| | 1st Green Body | 1st Hardmetal Body | Comments |
| Wt. % Binder | 2.5 | 4.5 | Binder migrated into this body from the second |
| Binder Chemistry | Cobalt | Cobalt | |
| Particle Size | 1–5 μm | 1–5 μm | |
| | 2nd Green Body | 2nd Hardmetal Body | Comments |
| Wt. % Binder | 7.2 | 6.0 | Binder migrated from this body into the first |
| Binder Chemistry | Cobalt | Cobalt | |
| Particle Size | 1–12 μm | 1–12 μm | |
| Prior Art 3 | | | |
| | 1st Green Body | 1st Hardmetal Body | Comments |
| Wt. % Binder | 12 | ~9 | After an about 9 hour sintering, the binder level homogenized |
| Binder Chemistry | Cobalt | Cobalt | |
| Particle Size | 0.5–10 μm | 0.5–10 μm | |
| | 2nd Green Body | 2nd Hardmetal Body | |
| Wt. % Binder | 6 | ~9 | |
| Binder Chemistry | Cobalt | Cobalt | |
| Particle Size | 0.5–10 μm | 0.5–10 μm | |
| Prior Art 4 | | | |
| | 1st Green Body | 1st Hardmetal Body | Comments |
| Wt. % Binder | 12 | ~11 | After about 45 minutes at about 2100° F. a continuously varying binder level resulted |
| Binder Chemistry | Cobalt | Cobalt | |
| Particle Size | 0.5–10 μm | 0.5–10 μm | |

TABLE 2-continued

| Comparison of the Prior Art | | |
|---|---|---|
| | 2nd Green Body | 2nd Hardmetal Body |
| Wt. % Binder | 6 | 6 |
| Binder Chemistry | Cobalt | Cobalt |
| Particle Size | 0.5–10 μm | 0.5–10 μm |

TABLE 3

| SAMPLES MADE BY THE PRESENT INVENTION | | | |
|---|---|---|---|
| Sample A(different binder chemistry) | | | |
| | 1st Green Body | 1st Hardmetal Body | Comments |
| Wt. % Binder | 14 | 14 | The hardmetal had an A00, B00, C00 porosity rating |
| Binder Chemistry | 2.8% Nickel 11.2% Cobalt | 2.8% Nickel 11.2% Cobalt | |
| Particle Size | ~3.2 μm | ~2.5 μm | |
| | 2nd Green Body | 2nd Hardmetal Body | Comments |
| Wt. % Binder | 14 | 14 | The hardmetal had an A00, B00, C00 porosity rating |
| Binder Chemistry | Co | Co | |
| Particle Size | ~3.2 μm | ~2.5 μm | |
| Sample B(different green bodies) | | | |
| | 1st Green Body | 1st Hardmetal Body | Comments |
| Wt. % Binder | 6 | 6 | The hardmetal had an A00, B00, C00 porosity rating |
| Binder Chemistry | Co | Co | |
| Particle Size | ~3.2 μm | ~2.5 μm | |
| | 2nd Green Body | 2nd Hardmetal Body | Comments |
| Wt. % Binder | 8 | 8 | The hardmetal had an A00, B00, C00 porosity rating |
| Binder Chemistry | Co | Co | |
| Particle Size | ~5.2 μm | ~4 μm | |
| Sample C(different sintered hardmetal bodies) | | | |
| | 1st Hardmetal Body | 1st Hardmetal Body | Comments |
| Wt. % Binder | 6 | 6 | The hardmetal had an A00, B00, C00 porosity rating |
| Binder Chemistry | Co | Co | |
| Particle Size | ~3.2 μm | ~3.2 μm | |
| | 2nd Hardmetal Body | 2nd Hardmetal Body | Comments |
| Wt. % Binder | 8 | 8 | The hardmetal had an A00, B00, C00 porosity rating |
| Binder Chemistry | Co | Co | |
| Particle Size | ~5.4 μm | ~5.4 μm | |
| Sample D(metal body and sintered hard metal body) | | | |
| | 1st Green Body | 1st Hardmetal Body | Comments |
| Wt. % Binder | 6 | 6 | The hardmetal had an A00, B00, C00 porosity rating |
| Binder Chemistry | Co | Co | |
| Particle Size | ~3.2 μm | ~3.3 μm | |

TABLE 3-continued

| SAMPLES MADE BY THE PRESENT INVENTION | | | |
|---|---|---|---|
| | Metal Body | Metal Body | Comments |
| Wt. % Binder<br>Binder Chemistry<br>Particle Size | 4340 steel | | The interface had substantially no porosity, substantially no intermetallics and substantially no porosity |
| | Sample E(different green bodies) | | |
| | 1st Green Body | 1st Hardmetal Body | Comments |
| Wt. % Binder<br>Binder Chemistry<br>Particle Size | 13<br>Co<br>~3.2 μm | 13<br>Co<br>~2.5 μm | The hardmetal had an A00, B00, C00 porosity rating |
| | 2nd Green Body | 2nd Hardmetal Body | Comments |
| Wt. % Binder<br>Binder Chemistry<br>Particle Size | 16<br>Co<br>~3.2 μm | 16<br>Co<br>~2.5 μm | The hardmetal had an A00, B00, C00 porosity rating |
| | Sample F(different green bodies) | | |
| | 1st Green Body | 1st Hardmetal Body | Comments |
| Wt. % Binder<br>Binder Chemistry<br>Particle Size | 13<br>Co<br>~3.2 | 13<br>Co<br>~2.5 | The hardmetal had an A00, B00, C00 porosity rating |
| | 2nd Green Body | 2nd Hardmetal Body | Comments |
| Wt. % Binder<br>Binder Chemistry<br>Particle Size | 16<br>Co<br>~5.4 μm | 16<br>Co<br>~4.8 μm | The hardmetal had an A00, B00, C00 porosity rating |
| | Sample G(different green bodies) | | |
| | 1st Green Body | 1st Hardmetal Body | Comments |
| Wt. % Binder<br>Binder Chemistry<br>Particle Size | 0<br>—<br>0.4 μm | 0<br>—<br>0.3 μm | The hardmetal had an A00, B00, C00 porosity rating |
| | 2nd Green Body | 2nd Hardmetal Body | Comments |
| Wt. % Binder<br>Binder Chemistry<br>Particle Size | 13<br>Co<br>~3.2 μm | 13<br>Co<br>~2.5 μm | The hardmetal had an A00, B00, C00 porosity rating |
| | Sample H(different green bodies) | | |
| | 1st Green Body | 1st Hardmetal Body | Comments |
| Wt. % Binder<br>Binder Chemistry<br>Particle Size | 10<br>Co<br>~1.0 μm | 10<br>Co<br>~1 μm | The hardmetal had an A00, B00, C00 porosity rating |
| | 2nd Green Body | 2nd Hardmetal Body | Comments |
| Wt. % Binder<br>Binder Chemistry<br>Particle Size | 8<br>Co<br>5.2 μm | 8<br>Co<br>~4.2 μm | The hardmetal had an A00, B00, C00 porosity rating |

TABLE 3-continued

| SAMPLES MADE BY THE PRESENT INVENTION | | | |
|---|---|---|---|
| | Sample I(different green bodies) - Roc temp 1400 C. | | |
| | 1st Green Body | 1st Hardmetal Body | Comments |
| Wt. % Binder<br>Binder Chemistry<br>Particle Size | 14<br>Co<br>~3.2 μm | 14<br>Co<br>~3.5 μm | The hardmetal had an A00, B00, C00 porosity rating |
| | 2nd Green Body | 2nd Hardmetal Body | Comments |
| Wt. % Binder<br>Binder Chemistry<br>Particle Size | 14<br>Co<br>~5.2 μm | 14<br>Co<br>~5.4 μm | The hardmetal had an A00, B00, C00 porosity rating |
| | Sample J(different green bodies) - Roc temp 1400 C. | | |
| | 1st Green Body | 1st Hardmetal Body | Comments |
| Wt. % Binder<br>Binder Chemistry<br>Particle Size | 6<br>Co<br>~3.2 μm | 7.2<br>Co<br>~3.4 μm | The hardmetal had an A00, B00, C00 porosity rating |
| | 2nd Green Body | 2nd Hardmetal Body | Comments |
| Wt. % Binder<br>Binder Chemistry<br>Particle Size | 8<br>Co<br>5.2 μm | 7.2<br>Co<br>~5.3 μm | The hardmetal had an A00, B00, C00 porosity rating |

Note:
The grain size of the green body was obtained by measuring the WC grain size in a sintered piece obtained by sintering the WC raw materials with 6% Co at 1440 C. in a SinterHIP furnace. All sub micron grains had 0.2% VC in them.

The metal content of the hardmetal bodies of Table 3 was determined by inductively coupled argon plasma emission spectroscopy using the radial viewing mode. A four point multivariate calibration was performed with calibration solutions produced from high purity metals, and accuracy verified to one percent relative using synthetically prepared quality assurance samples. The equipment used was a Perkin-Elmer 3300DV spectrometer. The data of Table 3 for the green bodies was obtained from consolidated monolithic bodies. The data of Table 3 for multiple-region bodies was obtained from sections of the $1^{st}$ hardmetal body and the $2^{nd}$ hardmetal body that had been cut from the multiple-region bodies to exclude the substantially discontinuous gradient-free boundary between the autogenously and/or contiguously contacting $1^{st}$ hardmetal body and $2^{nd}$ hardmetal body. In an aspect of the present invention, the substantially discontinuous gradient-free boundary between the autogenously and/or contiguously contacting hardmetal body and additional body may refer to the substantially discontinuous gradient-free change of the content and/or composition of the binder.

Other embodiments of the invention will be apparent to those skilled in the art from a consideration of the specification or practice of the invention disclosed herein. For example, the multiple-region bodies of the present invention may be used for materials manipulation or removal including, for example, as buttons or inserts or portions of buttons or inserts for oil field tools, petroleum industry or exploration tools, mining, construction, agricultural, wear, and metal removal applications.

Some examples of oil field tools, petroleum industry or exploration tools include down the hole bits including fixed cutting bits, tricone and rotating percussion bits having hard inserts and/or buttons therein. Some multiple-region bodies for use, for example, as a petroleum bit made in accordance with the present invention included an about 10 wt. % cobalt cemented tungsten carbide (WC) hardmetal body comprising the top and forward portion of the petroleum bit autogenously and/or contiguously bonded to an about 12 wt. % cobalt cemented tungsten carbide (WC) additional hardmetal body comprising the outside and reward portion of the petroleum bit. Other multiple-region bodies for use, for example, as a petroleum bit (for fixed cutters) made in accordance with the present invention included an about 13 wt. % cobalt cemented tungsten carbide (WC) hardmetal body comprising the top and forward portion of the petroleum bit surrounded and supported by an about 16 wt. % cobalt cemented tungsten carbide (WC) additional hardmetal body comprising the outside and reward portion of the petroleum bit. Another use of multiple-region bodies, for example, is as a petroleum bit (for fixed cutters) made in accordance with the present invention including an about 13 wt. % cobalt cemented tungsten carbide (WC) hardmetal body comprising the top and forward portion of the petroleum bit surrounded and supported by an about 14 wt. % cobalt cemented tungsten carbide (WC) additional hardmetal body comprising the outside and reward portion of the petroleum bit. Thus, these multiple-region bits may comprise a hardmetal body 12 comprising about 0 to about 20 wt. % binder and a grain size of about 0.2 $\mu$m to about 8 $\mu$m and an additional hardmetal body 14 comprising about 6 wt. % to about 25 wt. % and a grain size of about 2 $\mu$m to about 8 $\mu$m.

Some examples of agricultural applications include inserts for agricultural tools, disc blades, seed boots, stump cutters or grinders, furrowing tools, and earth working tools.

Some examples of mining and construction applications include cutting or digging tools, earth augers, mineral or rock drills, construction equipment blades, rolling cutters, earth working tools, comminution machines, and excavation tools.

More particular examples of mining and construction applications include conical style inserts, or portions thereof, for road milling and road planing, rotatable construction bits and rotatable scale mining bits, conical, cylindrical, flat or log cabin style inserts, or portions of inserts, for roof bits, nonrotatable mining bits, auger bits, snowplow blades and scarifier blades.

Some multiple-region bodies for use, for example, as a percussion bit made in accordance with the present invention included an about 6 wt. % cobalt cemented tungsten carbide (WC) hardmetal body comprising the top and forward portion of the percussion bit surrounded and supported by an about 8 wt. % cobalt cemented tungsten carbide (WC) additional hardmetal body comprising the outside and reward portion of the percussion bit. The percussion bit body was cross-sectioned, polished and the Rockwell A (Ra) measured along substantially equidistant intervals from the hardmetal body 12 across the substantially discontinuous gradient-free boundary to additional hardmetal body 14. The Ra hardness of the hardmetal body 12 measured 91.3, 91.4 and 91.4 moving toward the substantially discontinuous gradient-free boundary. The Ra hardness of the additional hardmetal body 14 measured 89.9, 89.8 and 89.9 moving away from the substantially discontinuous gradient-free boundary.

Some examples of wear applications include anvils for, among other things, high-pressure high-temperature superhard materials manufacturing, nozzles or portions of nozzles for directing abrasive materials such as sand blasting nozzles, waterjet nozzles and abrasive waterjet nozzles.

Some examples of materials removal applications include drills, endmills, reamers, threading tools, or turning, boring, drilling, milling or sawing inserts, incorporating chip control features, and materials cutting or turning, boring, drilling milling or sawing inserts comprising coating applied by any of chemical vapor deposition (CVD), physical vapor deposition (PVD), modifications of CVD and/or PVD, combinations of CVD and PVD, conversion coating, etc.

Some multiple-region bodies for use, for example, as an end mill made in accordance with the present invention included an about 10 wt. % cobalt cemented fine grained tungsten carbide (WC) hardmetal body comprising the outside or sleeve portion of the end mill surrounding an about 8 wt. % cobalt cemented coarse grained tungsten carbide (WC) additional hardmetal body comprising the core portion of the end mill. Other multiple-region bodies for use, for example, as a drill made in accordance with the present invention included an about 6 wt. % cobalt cemented fine grained tungsten carbide (WC) hardmetal body comprising the outside or sleeve portion of the drill surrounding an about 8 wt. % cobalt cemented coarse grained tungsten carbide (WC) additional hardmetal body comprising the core portion of the end mill.

Some multiple-region bodies for use, for example, as a superhard material substrate were made in accordance with the present invention. Applicants have found that these multiple-region superhard material substrates may comprise a hardmetal body 12 comprising about 6 wt. % to about 16 wt. % binder and a grain size of about 2 $\mu$m to about 8 $\mu$m and an additional hardmetal body 14 comprising about 8 wt. % to about 20 wt. % and a grain size of about 2 $\mu$m to about 10 $\mu$m.

The subject matter of all documents, including patents and patent publications, referred to in the present application is hereby incorporated by reference in its entirety herein.

It is intended that the specification and examples be considered as illustrative only, with the true scope and spirit of the invention being indicated by the following claims.

What is claimed is:

1. A tool piece comprising:

(a) a hardmetal body;

(b) an additional body contiguously contacting the hardmetal body;

(c) a substantially discontinuous gradient-free boundary, formed at a temperature less than a temperature for forming a liquid phase and a superatmospheric pressure, between the hardmetal body and the additional body; and (d) a mating surface between the hardmetal body and the additional body including macro mating features having a macro feature area to a perturbated macro feature area ratio comprising slightly greater than about 1:2 to about 1:50.

2. The tool piece according to claim 1, wherein the macro feature area to the perturbated macro feature area ratio comprises slightly greater than about 1:3 to about 1:50.

3. The tool piece according to claim 1, wherein the mating surface includes a male portion on one of the bodies and a corresponding female portion on the other of the bodies.

4. The tool piece according to claim 1, wherein the mating surface is symmetrical.

5. The tool piece according to claim 4, wherein the mating surface is axially symmetrical.

6. The tool piece according to claim 5, wherein the mating surface is dimpled.

7. The tool piece according to claim 1, wherein the mating surface is asymmetrical.

8. The tool piece according to claim 1, further including micro mating features thereby having both micro and macro mating features.

9. The tool piece according to claim 8, wherein the micro and macro mating features are represented as a periodic fiction subdivided into a finite number of continuous intervals within its period.

10. The tool piece according to claim 8, wherein the micro and macro mating features include one or more of half circles, half ovals, half ellipses, triangles, sawtooth curves, and truncated versions of any of the preceding.

11. The tool piece according to claim 1, wherein the macro feature area to the perturbated macro feature area ratio comprises slightly greater than about 1:2 to about 1:25.

12. The tool piece according to claim 11, wherein the macro feature area to the perturbated macro feature area ratio comprises slightly greater than about 1:2 to about 1:10.

13. The tool piece according to claim 1, wherein the micro mating feature comprises a size of about 100 $\mu$m to about 1 cm.

14. The tool piece according to claim 1, wherein the hardmetal has a porosity rating of no higher than substantially A06, B00, C08 to better than substantially A02, B00, and C00.

15. A tool piece, the tool piece comprising:

(a) a hardmetal body including a hard particle component and a binder;

(b) an additional body contiguously contacting the hardmetal body; and (c) a substantially discontinuous gradient-free boundary, formed at a temperature less than a temperature for forming a liquid phase and a superatmospheric pressure, between the hardmetal body and the additional body; and (d) a mating surface between the hardmetal body and the additional body including micro mating features and macro mating features, the macro mating features having a macro feature area to a perturbated macro feature area ratio comprising slightly greater than about 1:2 to about 1:25.

16. The tool piece according to claim 15, wherein the additional body comprises at least one of a metal body, a ceramic body, and an additional hardmetal body.

17. The tool piece according to claim 15, wherein the additional body comprises at least one a additional hardmetal body including a hard particle component and a binder.

18. The tool piece according to claim 17, wherein the hard particle components are a carbide.

19. The tool piece according to claim 18, wherein the carbide is a tungsten carbide.

20. The tool piece according to claim 19, wherein the carbide grain size is about 0.2 $\mu$m to about 40 $\mu$m.

21. The tool piece according to claim 17, wherein the binder of the hardmetal bodies is selected from the group consisting of cobalt, nickel, iron, and their alloys.

22. The tool piece according to claim 21, wherein the binder of the hardmetal body comprises a composition substantially different from the binder of the additional hardmetal body.

23. The tool piece according to claim 15, wherein the binder comprises cobalt or cobalt alloys.

24. The tool piece according to claim 8, wherein the binder of each hardmetal body is about 0 wt. %. to about 25 wt. %.

25. A tool piece, the tool piece comprising:

(a) a hardmetal body including a hard particle component and a binder;

(b) an additional body contiguously contacting the hardmetal body, (c) a substantially discontinuous gradient-free boundary, formed at a temperature less than a temperature for forming a liquid phase and a superatmospheric pressure, between the hardmetal body and the additional body; and (d) a mating surface between the hardmetal body and the additional body including macro mating features having a macro feature area to a perturbated macro feature area ratio comprising slightly greater than about 1:2 to about 1:50.

26. The tool piece according to claim 25, wherein the macro feature area to the perturbated macro feature area ratio comprises slightly greater than about 1:3 to about 1:50.

27. The tool piece according to claim 25, wherein the mating surface includes a male portion on one of the bodies and a corresponding female portion on the other of the bodies.

28. The tool piece according to claim 25, wherein the mating surface is symmetrical.

29. The tool piece according to claim 28, wherein the mating surface is axially symmetrical.

30. The tool piece according to claim 29, wherein the mating surface is dimpled.

31. The tool piece according to claim 25, wherein the mating surface is asymmetrical.

32. The tool piece according to claim 25, further including micro mating features thereby having both micro and macro mating features.

33. The tool piece according to claim 32, wherein the micro and macro mating features are represented as a periodic function subdivided into a finite number of continuous intervals within its period.

34. The tool piece according to claim 32, wherein the micro and macro mating features include one or more of half circles, half ovals, half ellipses, triangles, sawtooth curves, and truncated versions of any of the preceding.

35. The tool piece according to claim 25, wherein the macro feature area to the perturbated macro feature area ratio comprises slightly greater than about 1:3 to about 1:25.

36. The tool piece according to claim 35, wherein the macro feature area to the perturbated macro feature area ratio comprises slightly greater than about 1:3 to about 1:10.

37. The tool piece according to claim 25, wherein the micro mating feature comprises a size of about 100 $\mu$m to about 1 cm.

38. The tool piece according to claim 25 wherein the hardmetal has a porosity rating of no higher than substantially A06, B00, C08 to better than substantially A02, B00, and C00.

39. The tool piece according to claim 25, wherein the additional body comprises at least one of a metal body, a ceramic body, and an additional hardmetal body.

40. The tool piece according to claim 25, wherein the additional body comprises at least one additional hardmetal body including a hard particle component and a binder.

41. The tool piece according to claim 40, wherein the hard particle components are a carbide.

42. The tool piece according to claim 41, wherein the carbide is a tungsten carbide.

43. The tool piece according to claim 42, wherein the carbide grain size is about 0.2 $\mu$m to about 40 $\mu$m.

44. The tool piece according to claim 40, wherein the binder of the hardmetal bodies is selected from the group consisting of cobalt, nickel, iron, and their alloys.

45. The tool piece according to claim 44, wherein the binder of the hardmetal body comprises a composition substantially different from the binder of the additional hardmetal body.

46. The tool piece according to claim 25, wherein the binder comprises cobalt or cobalt alloys.

47. This tool piece according to claim 32, wherein the binder of each hardmetal body is about 0 wt. % to about 25 wt. %.

* * * * *